US011230451B2

(12) United States Patent
Bhaskaran et al.

(10) Patent No.: US 11,230,451 B2
(45) Date of Patent: Jan. 25, 2022

(54) ESTIMATE COUNT OF PRINT MEDIA

(71) Applicant: Hewlett-Packard Development Company, L.P., Spring, TX (US)

(72) Inventors: Shinoj Bhaskaran, Bangalore (IN); Subhash Pulikkara Veedu, Bangalore (IN); Vineeth R, Bangalore (IN); Sharmakumar Ponnarassery Sasankan, Bangalore (IN); Anoop Vembanat, Bangalore (IN); Cijo Robert, Bangalore (IN)

(73) Assignee: Hewlett-Packard Development Company, L.P., Spring, TX (US)

( * ) Notice: Subject to any disclaimer, the term of this patent is extended or adjusted under 35 U.S.C. 154(b) by 102 days.

(21) Appl. No.: 16/625,450

(22) PCT Filed: May 7, 2018

(86) PCT No.: PCT/US2018/031313
§ 371 (c)(1),
(2) Date: Dec. 20, 2019

(87) PCT Pub. No.: WO2019/009953
PCT Pub. Date: Jan. 10, 2019

(65) Prior Publication Data

US 2021/0147165 A1 May 20, 2021

(30) Foreign Application Priority Data

Jul. 5, 2017 (IN) ..... 201741023701

(51) Int. Cl.
*B65H 7/02* (2006.01)
*B65H 1/04* (2006.01)

(52) U.S. Cl.
CPC ..... *B65H 7/02* (2013.01); *B65H 1/04* (2013.01); *B65H 2511/152* (2013.01); *B65H 2511/30* (2013.01)

(58) Field of Classification Search
CPC ... B65H 1/00; B65H 1/04; B65H 7/00; B65H 7/02; B65H 7/04; B65H 7/14; B65H 7/20;
(Continued)

(56) References Cited

U.S. PATENT DOCUMENTS 6,113,094 A 9/2000 Horiguchi et al.
6,275,664 B1 8/2001 Wolf et al.
(Continued)

OTHER PUBLICATIONS

Foto Club~Free~New Printer Info App V1.2 for DNP DS or RX Printers, Oct. 26, 2015~http://www.fotoclubinc.com/blog/~4 pages.

*Primary Examiner* — Prasad V Gokhale
(74) *Attorney, Agent, or Firm* — HP Inc. Patent Department

(57) ABSTRACT

Examples for estimating quantity of print media available in a device, are described. In one example, the device comprising includes a series of proximity sensors to sense level of a stack of print media. The sensors are mounted on an internal vertical wall of the media tray with each of the plurality of sensors mounted at a different vertical height. Based on the sensing by the sensors, an estimate count of the print media available in a media tray of the device is generated.

14 Claims, 5 Drawing Sheets

(58) Field of Classification Search
CPC ..... B65H 2511/152; B65H 2511/30; B65H 2553/416
See application file for complete search history.

(56) References Cited

U.S. PATENT DOCUMENTS

| | | | | |
|---|---|---|---|---|
| 6,378,860 | B1 * | 4/2002 | Gutierrez | B65H 31/10 271/176 |
| 9,126,790 | B2 | 9/2015 | Ooba | |
| 2003/0113124 | A1 | 6/2003 | Barlow | |
| 2009/0027733 | A1 | 1/2009 | Uehara et al. | |
| 2011/0056266 | A1 | 3/2011 | Gagnon et al. | |
| 2012/0315072 | A1 | 12/2012 | Kurita | |
| 2013/0235411 | A1 | 9/2013 | Oba | |
| 2014/0084536 | A1 * | 3/2014 | Matos | G03G 15/6502 271/145 |
| 2021/0039915 | A1 * | 2/2021 | Low | G06F 3/1244 |

* cited by examiner

ESTIMATE COUNT OF PRINT MEDIA

BACKGROUND

Multi-functional device (MFD), such as facsimile machine, copier, or printer, is generally used for rendering content, such as text, numeric, graphic, photographic, or similar data, on a print media. The print media is generally in the form of a paper sheet, a transparency sheet, or a photo sensitive sheet, and is arranged in a stack within a media holding tray of the MFD. In operation, the media is drawn out one by one from the media holding tray for rendering of the content on the print media. As the print media is utilized from the media holding tray, it may be replenished accordingly. In some cases, the MFD may include a sensor is mounted within the media holding tray to indicate when the media holding tray has either emptied or is low on the print media.

BRIEF DESCRIPTION OF FIGURES

The following detailed description references the drawings, wherein.

DETAILED DESCRIPTION

Figure 1:
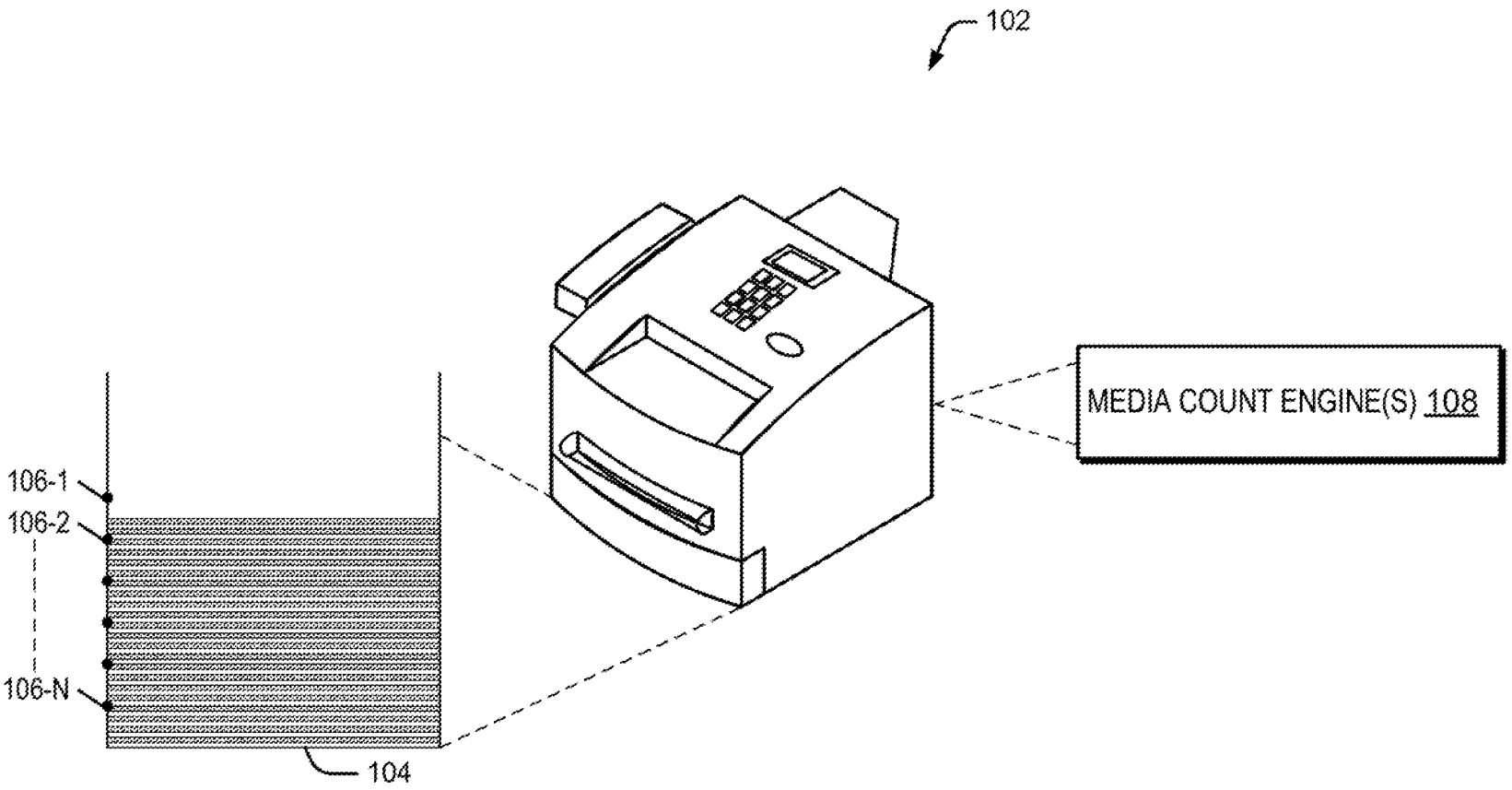
FIG. 1 is a diagram of an example multi-functional device for ascertaining quantity of print media in a media holding tray.

The present subject matter relates to a multifunction device (MFD), such as a printer, a copier, a facsimile machine, and other imaging device. An MFD is generally used for rendering content onto a print media. Different types of MFDs may render the content onto the print media through different rendering operations. A rendering operation may be considered as any operation that may be undertaken by a MFD for rendering content onto a print media. For example, MFD may render content by a printing process in response to a print command. Similarly, for copiers a digital representation of a printed document may be rendered by a photocopying process onto the print media to obtain a replica of a printed document.

The print media is generally stored as a stack within a media holding tray. From the media holding tray (hereinafter referred to as media tray), the print media is drawn one by one for rendering the content either as part of rendering operation. As the print media is utilized from the media tray for processing of the rendering operation, the print media may have to be manually replenished. Generally, to estimate whether print media is present or not, the MFD may include a sensor to indicate when the media tray has emptied or is low on the print media. Such a sensing mechanism notifies users when the print media is running low. Such sensing mechanism, however, may not notify the quantity of print media which may be available within the media tray.

Approaches for ascertaining quantity of print media present in a multifunctional device (MFD) are described. In one example, the MFD includes a series of sensors which are mounted on a media tray of the MFD. The sensors may be positioned on an internal vertical wall of the media tray. The sensors are equally spaced with respect to each other, and may be so positioned such that each of the sensors are positioned at a different vertical height with respect to the bottom of the media tray.

In operation, a top level of a stack of print media in the media tray may be detected by an initial sensor which is closest to a top-most print media positioned in the stack in the media tray. In case the media tray is full or nearly full, the initial sensor may be a top-most sensor from amongst the plurality of sensors. Further, as a rendering operation is being carried out, the level of the print media in the media tray would continue to decrease till the level of the print media stack approaches the next lower sensor. At this stage, the quantity of print media utilized since the top level being sensed by the top-most sensor till the level of the print media stack reaches the next lower sensor, is determined and is referred to as preliminary count. Since all the sensors in the series of sensors are equally spaced, it is estimated that the number of the print media between each of the adjacent sensors amongst the plurality of sensors is likely to be equal to the preliminary count thus determined.

Once the preliminary count is determined, it is multiplied by a value corresponding to the number of sensors that are present beneath the initial sensor to ascertain an estimate of the number count, i.e., a quantity of the print media available in the media tray. Once the number count is determined, it may be further updated depending on subsequent rendering operations that may be carried out. For example, depending on the quantity of the print media expended during a subsequent rendering operation, the number count may be accordingly updated to reflect the quantity of print media available in the media tray.

In another example, a command for a rendering operation may be further processed to determine an intended quantity of print media which may be used for completing the rendering operation. The intended number of the print media may be compared recurrently with the number count. Based on such comparisons it may be ascertained whether the number of the print media is sufficient for completing the rendering operation. In one example, in case the number of the print media is not sufficient, an appropriate alert or an indication may be generated and communicated to the user.

The proposed approaches determine and obtain an accurate estimation of the quantity of the print media present in the media tray during a rendering operation. Furthermore, it may also be ascertained whether appropriate amount of the print media is available when the rendering operation has been initiated. In one example, the number count may also be displayed on a display panel associated with the MFD allowing any user to be informed of the quantity of print media which may be available within the media tray. It is also to be noted that although the present description has been described in relation to a multi-function device, the present approaches may also be implemented on standalone devices configured to render content through a single operation. Examples of such devices include, but are not limited to, printers and photocopying machines.

These and other aspects are described in conjunction with various examples as illustrated in FIGS. 1-5. The present description is provided for multifunctional devices which may have an internal media tray. Other multifunctional devices may also be included within the scope of the present subject matter without any limitation. Furthermore, in some figures, various components for which no protection is sought have been illustrated using dotted lines.

FIG. 1 illustrates a content rendering device 102 (referred to as device 102), for ascertaining a quantity of print media in a media tray 104. The device 102 may be a copier, or a printer, or any multi-function device incorporating such multiple functionalities for rendering content, such as text, numeric, graphic, photographic, or similar data, on the print media. The device 102 may include a series of sensors 106-1, 2, . . . , N (collectively referred to as sensors 106). The sensors 106 are arranged linearly and mounted on an internal vertical wall of the media tray 104. In one example, each of the sensors 106 in the media tray 104 detect level of a stack of print media once topmost print media is within a minimum threshold distance from any one of the sensors 106. The device 102 further includes a media count engine(s) 108. The media count engine(s) 108 may be communicatively coupled to the sensors 106.

In operation, as a rendering operation is being carried out, a top of the print media stack in the media tray 104 may be detected by an initial sensor, say sensor 106-1. Any one of the sensors 106 may detect the top of the print media stack when the top of the stack is within a threshold distance from the corresponding one of sensors 106. Detecting by any sensor may indicate that the level of the stack is about the vertical height at which any one of such sensors 106 is positioned.

In the present example, detecting the top of the media stack by the sensor 106-1 indicates that the level of the media stack is the same as the position of the sensor 106-1. As the rendering operation continues, the quantity of the print media is utilized for completing the rendering operation. As the quantity of the print media decreases, it will be subsequently detected by a next lower sensor 106-2. At this stage, a preliminary count may be determined which corresponds to a number count of the print media utilized for the rendering operation as the level of the media stack changed from the initial level to the next lower level.

Since all the sensors in the series of sensors 106 are equally spaced, a number count of print media may be assumed to be present between each of the adjacent sensors 106. Using the preliminary count, a value of the preliminary count may be multiplied by a number of sensors positioned beneath the initial sensor to provide an estimate count of the print media present in the media tray 104. Based on the estimate count of the print media, the media count engine(s) 108 may enable determining and obtaining an accurate count of the print media available in the media tray 104. In an example, the accurate count of the available print may be rendered on a display panel (not shown in FIG. 1) in communication with the device 102, or a user computing device. In one example, the media count engine(s) 108 may further process commands corresponding to the rendering operation to determine an intended quantity of print media that may be utilized for completing the rendering operation. The media count engine(s) 108 may further compare the intended quantity with the estimate count to determine whether enough print media is available within the media tray 104 for processing the rendering operation.

Figure 2:
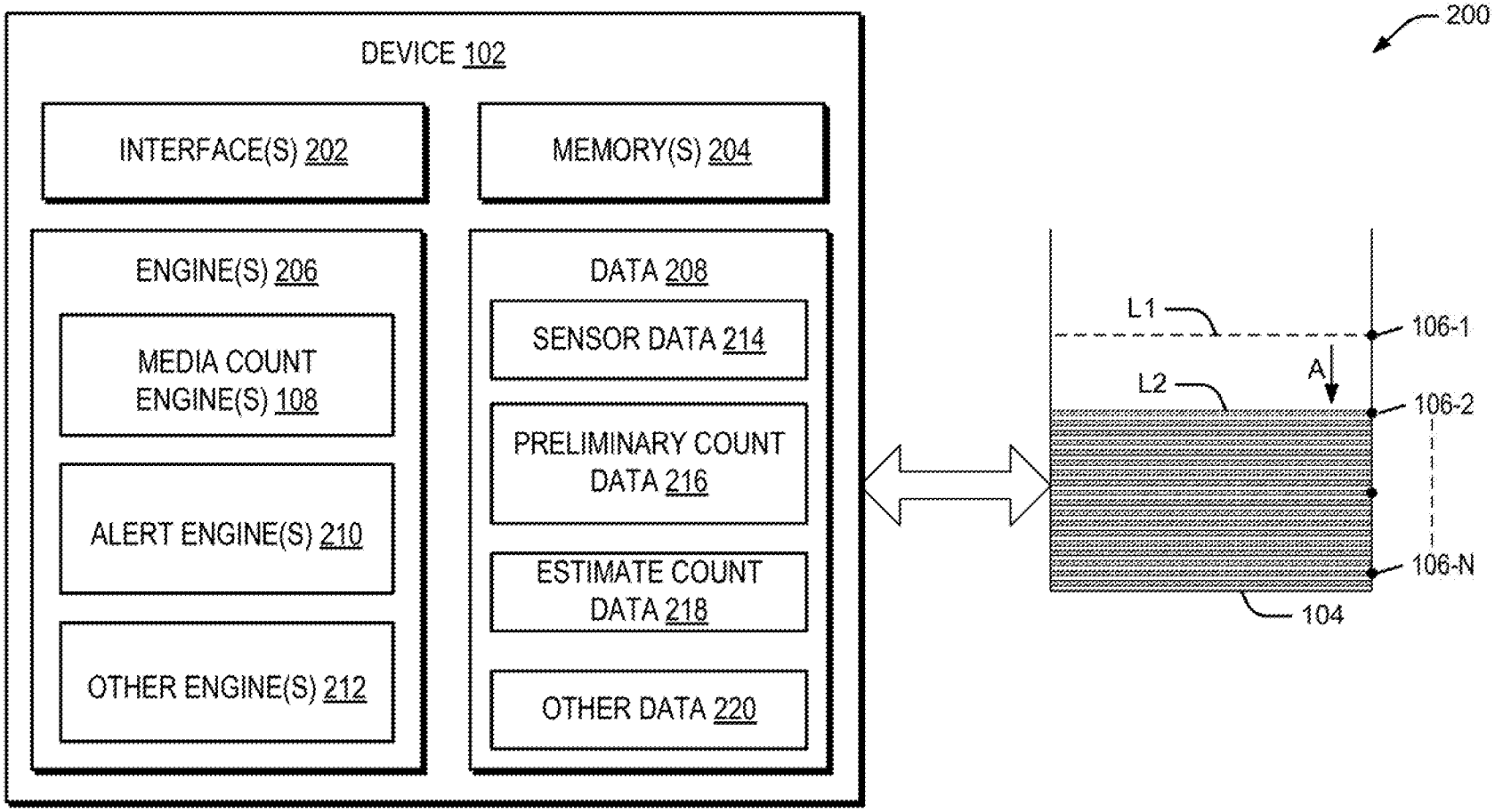
FIG. 2 is a diagram of another example multi-functional device for ascertaining quantity of print media in a media holding tray.

These and other functionalities are provided in further detail in conjunction with FIG. 2. FIG. 2 illustrates an exemplary environment 200 including the device 102 in communication with the media holding device 104. The media holding device 104 may be implemented as either a standalone device (as depicted) or may be integrated within the device 102, without deviating from the scope of the present subject matter. The media holding device 104 is hereinafter referred to as media tray 104 in the description hereinafter without deviating from the scope of the present subject matter.

The device 102 further includes interface(s) 202, memory(s) 204 and the sensors 106. The interface(s) 202 may include a variety of interfaces, for example, interfaces for data input and output devices, referred to as I/O devices, storage devices, network devices, and the like. The interface(s) 202 facilitate communication between the device 102 and other computing devices connected in a networked environment. In one example, the interface(s) 202 may provide an interface for communication between the device 102 and the media tray 104. The memory 204 may store computer-readable instructions, which may be fetched and executed, resulting in generating an alert to enable a user to retrieve a printed media. The memory 204 may include any non-transitory computer-readable medium including, for example, volatile memory such as RAM, or non-volatile memory such as EPROM, flash memory, and the like. The device 102 further includes engine(s) 206 and data 208.

The engine(s) 206 may be implemented as a combination of hardware and programming (for example, programmable instructions) to implement functionalities of the engine(s) 206. In examples described herein, such combinations of hardware and programming may be implemented in a number of different ways. For example, the programming for the engine(s) 206 may be processor executable instructions stored on a non-transitory machine-readable storage medium and the hardware for the engine(s) 206 may include a processing resource (for example, a single processor or a group of processors), to execute such instructions. In the present examples, the machine-readable storage medium may store instructions that, when executed by the processing resource, implement engine(s) 206. In such examples, the device 102 may include the machine-readable storage medium storing the instructions and the processing resource to execute the instructions, or the machine-readable storage medium may be separate but accessible to device 102 and the processing resource. In other examples, engine(s) 206 may be implemented by electronic circuitry.

The data 208 includes data that is either predefined, stored, or generated as a result of the functionalities implemented by any of the engine(s) 206. In an example, the engine(s) 206 include the media count engine(s) 108, an alert engine(s) 210 and other engine(s) 212. The other engine(s) 212 may implement functionalities that supplement applications or functions performed by the device 102. Further, the data 208 may include sensor data 214, a preliminary count data 216, an estimate count data 218 and other data 220.

The process for ascertaining a quantity of print media available in the media tray 104 may be triggered on receipt of a rendering command from a user intending to process a rendering operation on the print media. In an example, the printed media may be any media on which content may be rendered. Examples of such printed media includes but is not limited to, paper sheets, a transparency sheet, and a photo sensitive sheet.

Once the command for rendering operation is received for processing, the device 102 may activate the sensors 106 disposed on an internal vertical wall of the media tray 104 with each of the sensors 106 mounted at a different vertical height with respect to the bottom of the media tray 104. It should be noted that the measure of vertical height from the bottom of media tray 104 is only one example. The vertical height may be determined with respect to any reference point without deviating from the scope of the present subject matter.

The sensors 106 are equally spaced with respect to each other. In one example, the sensors 106 are proximity sensors. The sensors 106, in the present example, are utilized for determining a top of the stack of print media (referred to as the media stack) present in the media tray 104. In one example, the sensors 106 on sensing proximity of the print media may generate a plurality of signals. The plurality of signals may be used for estimating the level of print media available in the media tray 104.

The sensors 106 may be one of capacitive based proximity sensor and a photoelectric based proximity sensor, without limiting the scope of the present subject matter as recited in the claims presented herein. For example, the proximity sensors 106 may include include an optical signal emitter and an optical signal receiver. The level of the media stack L1 may be estimated when signals being emitted by a signal emitter are received by a signal receiver.

Returning to the present subject matter, once the sensors 106 are activated, the proximity sensors, such as the sensors 106, may sense the print media in their vicinity. Thus, depending on the presence of top of the stack of print media, the sensors 106 may generate signals which may be stored in sensor data 214 for further processing. The sensor data 214 pertaining to the signals generated by the sensors 106 in response to the presence of the top of the stack of the print media may be then obtained by the media count engine(s) 108.

The media count engine(s) 108 may process the sensor data 214 to ascertain the quantity of the print media available in the media tray 104. For example, the media count engine(s) 108 may utilize the sensor data 214 to determine an initial level L1 of the stack of the print media sensed by an initial sensor 106-1 which is in its proximity. In an example, the initial sensor 106-1 may be assumed as a top-most sensor laying beneath the top media level of the stack of the print media. In one example, a media level may be detected by a respective sensor in case a print media at that media level is at a threshold distance from the sensor and is in the line of sensing of the sensor. Accordingly, any one of the sensors 106 may detect the top of stack of the print media when the top of the stack is within a threshold distance from the respective one of sensors 106. Detecting of a level of the stack by any one of the sensors may indicate that the detected level is about a vertical height at which any one of such sensors 106 may be positioned.

Once the initial level L1 of the print media and the initial sensor 106-1 determining the initial level L1 are identified, the media count engine(s) 108 may keep a count of the number of print media used from the media tray 104 as any subsequent rendering operations are carried out by the device 102. For example, during the processing of the rendering operation, the level of the print media may continue to decrease (in a direction as shown by A) from the initial level L1 sensed by the initial sensor 106-1 till a next lower level L2 present along the next lower sensor 106-2. Once the next lower level L2 is reached, the number of print media which may have been utilized since the initial level L1 being sensed till the next lower level L2 is determined by the media count engine(s) 108 to provide a value of the preliminary count. The determined value of the preliminary count may then be stored in the preliminary count data 216. As described above, the value of the preliminary count may be a measure of the number of print media present between adjacent sensors 106. Since all the sensors in the series of sensors 106 are assumed to be equally spaced, the number of the print media between each of the adjacent sensors may also be assumed to be the same.

Next, the estimate count of the print media available in the media tray 104 is ascertained by the media count engine(s) 108. To this end, the media count engine(s) 108 may multiply the value of the preliminary count with a number of sensors positioned beneath the initial sensor 106-1 to provide an estimate count of the print media available in the media tray 104. For example, if 50 print media are counted (processed) between the two adjacent sensors and the number of sensors beneath the initial sensor is 3, then an estimate count of the print media remaining in the media tray 104 is: $50\times3=150$.

Further, in an alternative example, in order to account for variations in media width within the stack of the print media, the media count engine(s) 108 may utilize an average value of the stored preliminary count of the print media rather than simply the recently determined value of the preliminary count. The average value of the stored preliminary count may be calculated and kept over multiple media levels by the media count engine(s) 108, thus enabling an extremely adaptive estimate count of the print media in media tray 104 under the present disclosure. To clarify, each time a next lower level is detected by the media count engine(s) 108, instead of simply storing the current value of preliminary count, the current value may be averaged with the previously determined values of the preliminary count and then the average is stored in the preliminary count 216. One example of a simple calculation to accomplish this may be: new stored value=(current value+previously stored value)/2. However, other adaptive methods may be also equally feasible under principles of the present disclosure.

Returning to the present operation, the ascertained estimate count of the print media remaining in the media tray 104 is stored in the device 102 at the estimate count data 218, or reported by the media count engine(s) 108 on a display device (not shown in Figures) integrated within the device 102 or coupled to a computing device from where the command for rendering operation is received. Such reporting of the estimate count may enable the user to further track the estimate count in the media tray 104 during continued processing of the rendering operation.

In case the processing of the rendering operation by the device 102 continues after the estimate count, the estimate count of the available print media may be updated by the media count engine(s) 108 as the number of print media are being utilized from the media tray 104. Specifically, each individual print media that is picked from the media tray 104 for the processing the rendering operation may be counted by the media count engine(s) 108, and decremented from the estimate count of the print media available in the media tray 104. Such accurate decrementing count of the print media may be continuously displayed on the display device integrated within the device 102 or a command-provider computing device. The continuous display of the decrementing count of the print media may enable the user of the device 102 to determine and obtain an accurate count of the print media present in the media tray 104 as the rendering operation is being processed.

In one example, the media count engine(s) 108 may display on the display device that whether the estimate count or decrementing count is accurate or approximate. For example, the media count engine(s) 108 may display a flag indicating an accurate estimate count when the estimate count is ascertained based on a preliminary count value determined during the processing of the current ongoing rendering operation. However, in an example, the media count engine(s) 108 may display a flag indicating an approximate estimate count when the estimate count is ascertained based on a preliminary count value determined during processing of previous rendering operations processed at the device 102. For approximate estimate, the preliminary count value determined during previous processing may be retrieved by the media count engine(s) 108 from the preliminary count data 216, in cases the estimate count is to be ascertained when the device 102 is restarted, processing of a new rendering operation is restarted, or the media tray 104 is opened or closed for replenishing or removing the print media.

Upon, retrieval of the preliminary count value determined during previous processing, the media count engine(s) 108 may determine a number of sensors 106 positioned until a top-most print media with respect to the bottom of the media tray 104. Then, the media count engine(s) 108 multiplies the preliminary count value determined during previous processing with the number of determined sensors. For example, if the value of the preliminary count is retrieved as 50 and the number of sensors determined to be 4 up to the level of the top-most print media with respect to the bottom of the media tray 104, an approximate estimate count of the print media remaining in the media tray 104 may be: 50×4=200.

Furthermore, in another example, the alert engine(s) 210 may further generate visual or audio alerts in case the available print media in the media tray 104 is not sufficient to render the received request of rendering operation. For example, the alert engine(s) 210 may process the rendering operation request received at the device 102 to determine an intended number of print media which may be consumed to process the entire rendering operation. The alert engine(s) 210 may then compare the determined intended print media with the estimated count or the decrementing count to further determine whether the available print media can process the entire rendering operation. The alert engine(s) 210 may determine occurrence of instances where the count of available print media is not sufficient for processing the received rendering operation request. On occurrence of such instances, the alert engine(s) 212 may generate audio or visual cue to draw the attention of a user. The user may then appropriately take necessary action. In an example, on getting audio or visual cue, the user may manually refill the media tray 104 with the print media thereby avoiding the delay in processing of the rendering operation on the print media.

Figure 3:
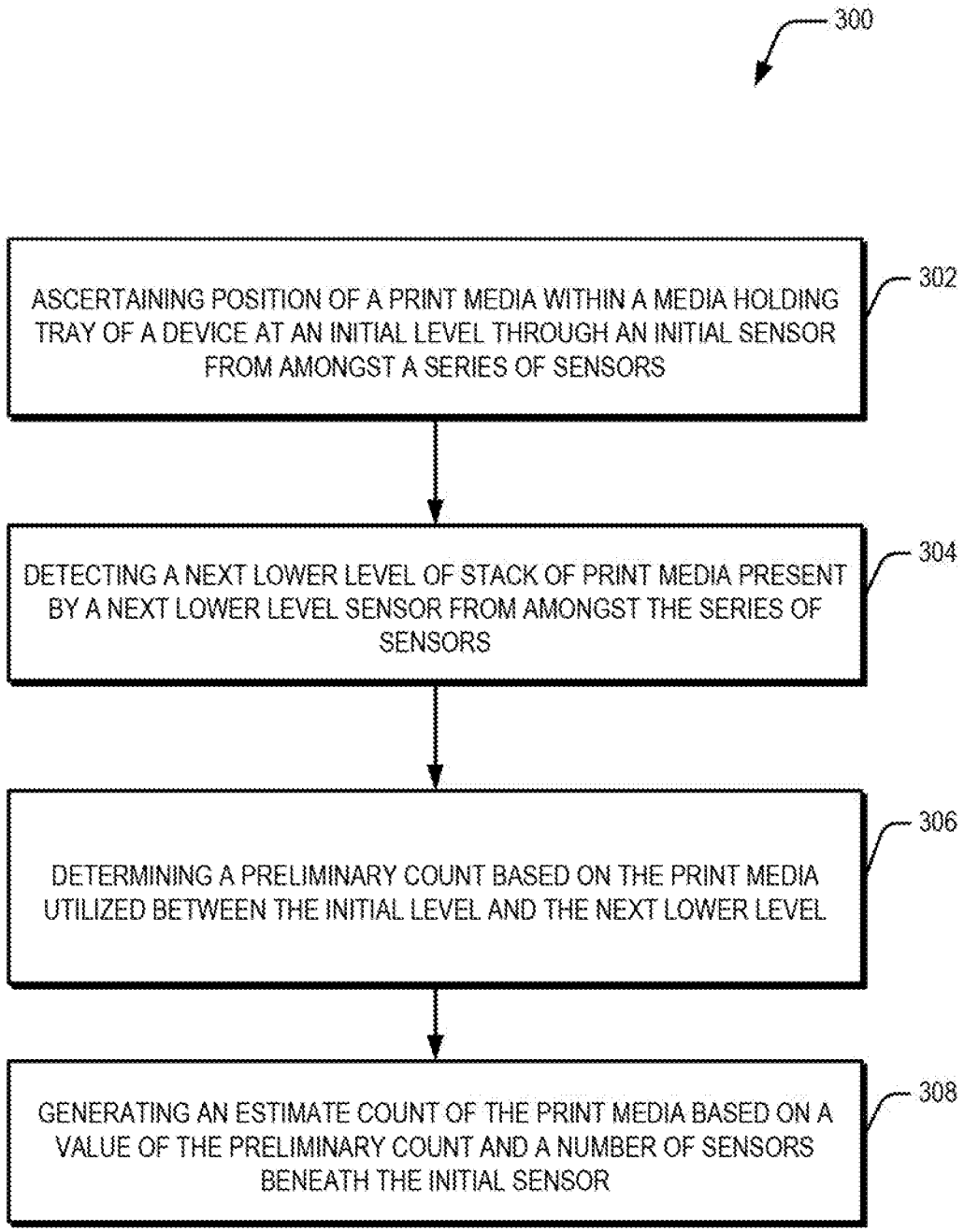
FIG. 3 depicts an example method for ascertaining quantity of print media in a media holding tray.
Figure 4:
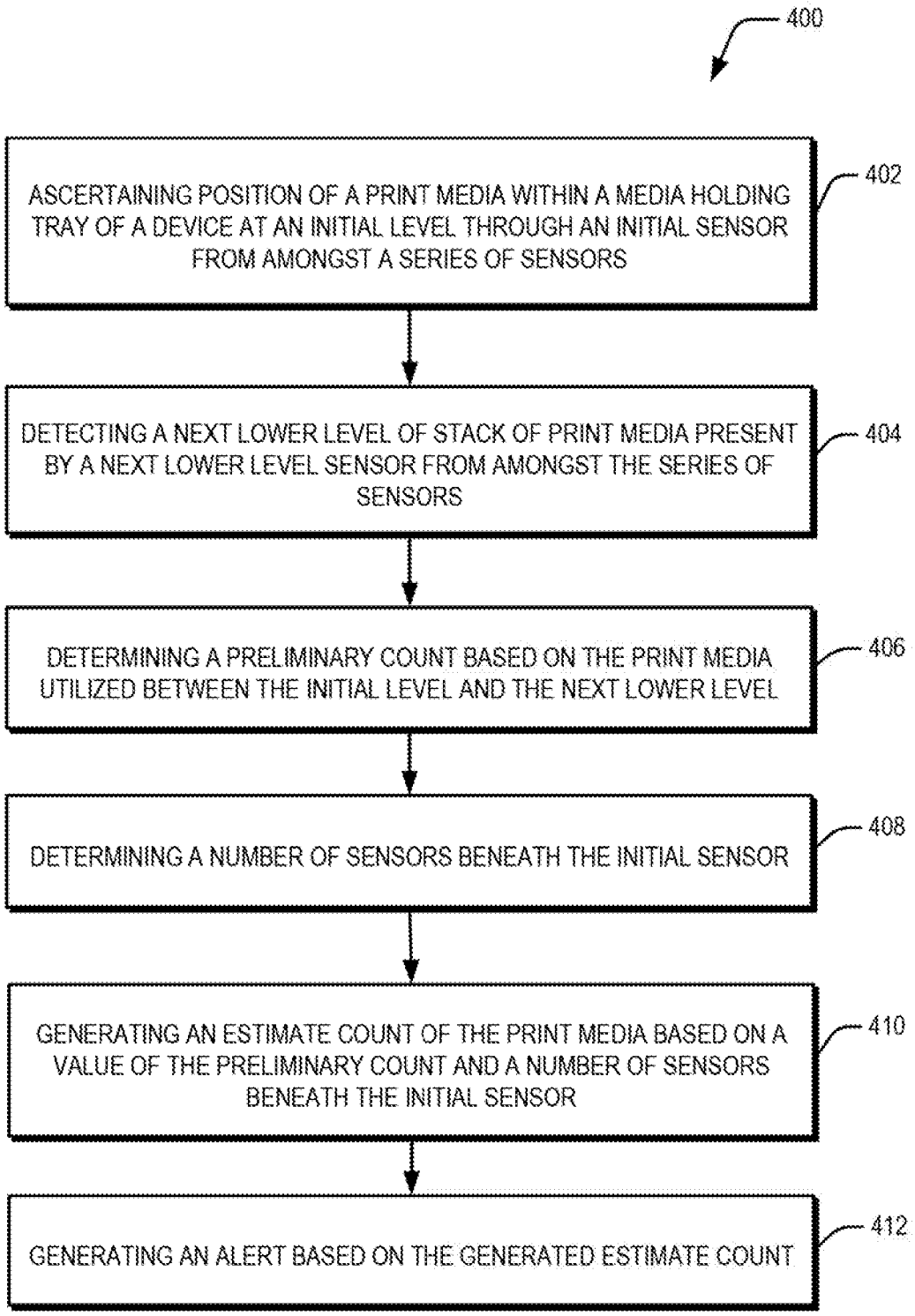
FIG. 4 depicts another example method for ascertaining quantity of print media in a media holding tray.

FIGS. 3-4 illustrate example methods 300 and 400, for ascertaining the quantity of print media available within the media tray 104 of a device, device 102, according to an implementation of the present subject matter. The order in which the methods are described is not intended to be construed as a limitation, and any number of the described method blocks may be combined in any order to implement the methods 300 and 400, or another method. Furthermore, methods 300 and 400 may be implemented by a processing resource or computing device(s) through any suitable hardware, non-transitory machine-readable instructions, or combination thereof.

Referring to FIG. 3, at block 302, position of the print media within the media tray 104 at an initial level is ascertained. For example, the position of the print media at the initial level L1 may be ascertained using any one of series of sensors 106 mounted on an internal vertical wall of the media tray 104. As explained previously each of the plurality of sensors are mounted at different vertical height with respect to the bottom of the media tray 104. The sensors 106 may be positioned equally spaced with respect to each other. In one example, a media level may be detected by a respective sensor in case a print media at that media level is at a threshold distance from the respective sensor and is in the line of sensing of the sensor. Accordingly, when the initial level L1 is at a threshold distance and is in the line of sensing of the initial sensor 106-1, the initial sensor 106-1 provides a signal indicative of the presence of the print media at the initial level L1. In present example, the initial level L1 may be a top level of stack of print media.

At block 304, level of stack of the print media present at a next lower level is detected by a next lower sensor. For example, the media count engine(s) 108 may determine the position of the print media at the next lower level L2 based on signal generated by the next lower level sensor, say sensor 106-2. The next lower level sensor 106-2 may generate signal when the level of stack of the print media is at the threshold distance and is in line of sensing of the next lower level sensor 106-2.

At block 306, the preliminary count based on quantity of the print media between the initial level L1 and the next lower level L2 is determined for processing a rendering operation. As described above, the preliminary count may be a value indicative of number of print media utilized between the initial level L1 and the next lower level L2 for the rendering operation.

At block 308, an estimate count of the print media available within the media tray 104 may be generated based on the value of the preliminary count and a number of sensors positioned beneath the initial sensor 106-1. In one example, the media count engine(s) 108 may generate an estimate count of the print media available within the media tray 104 by multiplying the value of the preliminary count with the number of sensors beneath the initial sensor 106-1.

FIG. 4 provides another example method 400 for ascertaining quantity of the print media available within the media tray 104 of the device, say, device 102. The method 400 may ascertain the estimate count of the media count in cases when the device 102 is restarted, processing of a new rendering operation is started, or the media tray 104 is opened or closed for replenishing or removing the print media.

At block 402, position of top of the stack of print media at an initial level L1 within the media tray 104 is ascertained. The ascertainment may be carried out using a series of sensors 106 arranged on an internal vertical wall of the media tray 104. In one example, each of the plurality of sensors may be arranged at disparate vertical height with respect to the bottom of the media tray 104, with the sensors 106 arranged equally spaced with respect to each other. With such arrangement of the sensors 106, each of the series of the sensors 106 may detect a top of stack of the print media which may be lying at a threshold distance and in the line of sensing of respective sensor. For example, in case a top of the stack of the print media is at a threshold distance and is in the line of sensing of a sensor, say the initial sensor 106-1, the initial sensor 106-1 may provide a signal indicating that the top of print media is at the initial level L1.

At block 404, level of the stack of print media present at a next lower level L2 is detected. The next lower level L2 may be detected based on proximity of the print media from a next lower level sensor 106-2. As described above, as the rendering operation being processed, the level of the stack of the print media may drop from the initial level L1 to the next lower level L2. The position of the print media at the next lower level L2 may be detected based on signal generated by the next lower level sensor, say sensor 106-2. For example, the next lower sensor 106-2 may generate signal indicative of the stack of print media at the next lower level L2 when the level of stack of the print media is at the threshold distance and is in line of sensing of the next lower level sensor 106-2.

At block 406, the preliminary count of the quantity of the print media utilized between the initial level L1 and the next lower level L2 for processing the rendering operation, is determined. As described above, all the sensors 106 are linearly arranged at equal distance from each other, a value of the preliminary count may be same between each of the adjacent sensors 106.

At block 408, a number of sensors laying beneath the initial sensor 106-1 is determined. The sensors laying beneath the initial sensor 106-1 until the bottom of the media tray 104 may be the sensors which sense presence of the print media in their vicinity. The number of such sensors may be determined for the estimation of the quantity of the print media in the media tray 104.

At block 410, an estimate count of the print media available within the media tray 104 is generated based on the value of the preliminary count and the determined number of sensors positioned beneath the initial sensor 106-1. In one example, the media count engine(s) 108 coupled to the series of sensors 106 may generate the estimate count of the print media available within the media tray 104 by multiplying the value of the preliminary count with the number of sensors beneath the initial sensor 106-1.

At block 412, an audio or visual alert for a user may be generated in case the estimated count of the print media in the media tray 104 is not sufficient for processing the rendering operation. For generating the audio or visual alert, a command of the rendering operation may be processed to determine an intended quantity of print media which may be utilized for completing the rendering operation. The determined intended quantity of print media may be compared with the estimated count to further determine whether the available print media can process the entire rendering operation. Based on the comparison, the audio or visual alert may be generated to draw the attention of a user. In one example, on getting audio or visual alert, the user may refill the media tray 104 or delay the entering of the submission of a command of the rendering operation over the device 102.

Figure 5:
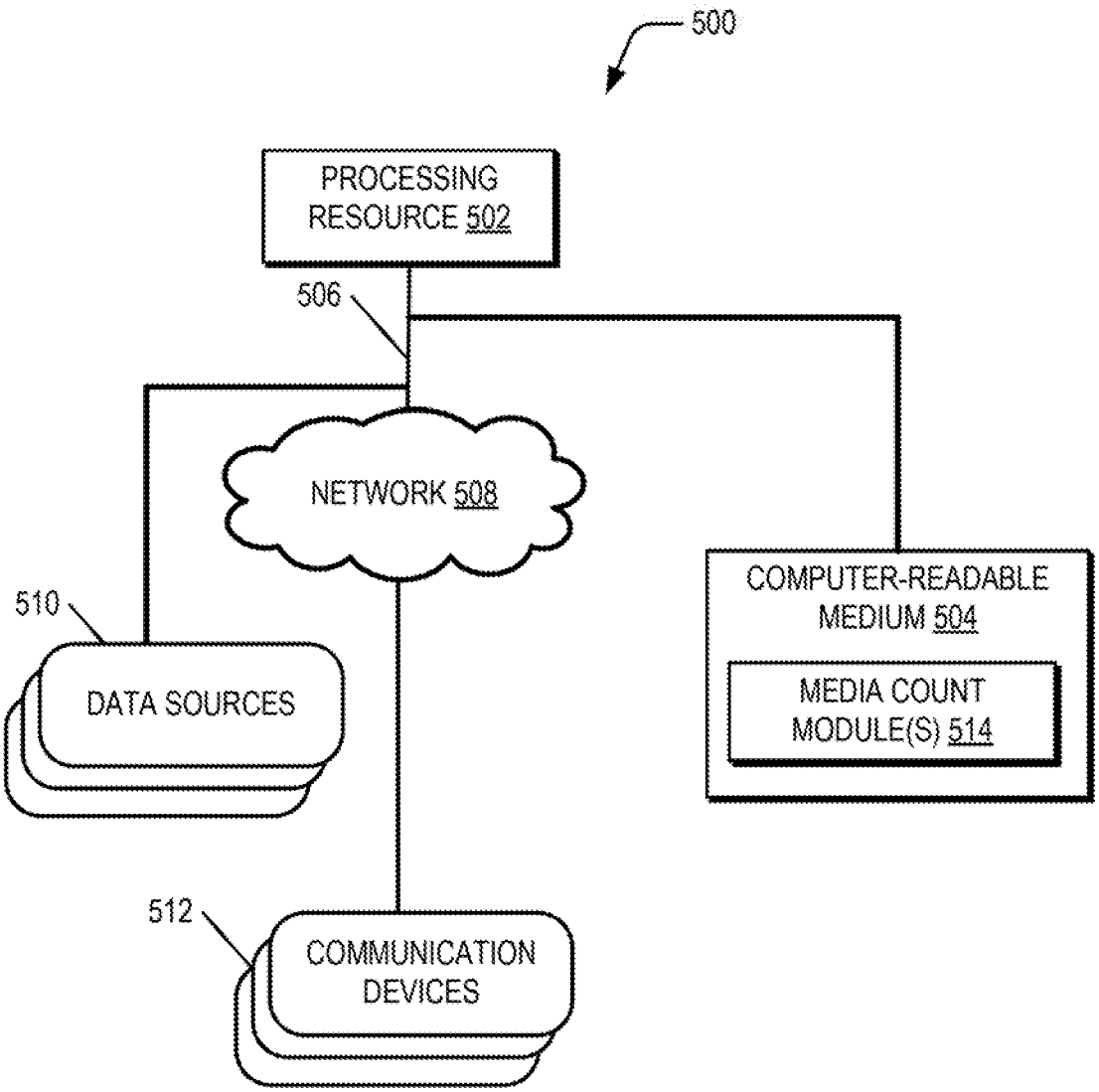
FIG. 5 is a block diagram of an example system implementing a non-transitory computer-readable medium, for ascertaining quantity of print media in a media holding tray.

FIG. 5 illustrates a system environment 500 for ascertaining a count of print media available within the media tray 104 of the device 102, according to an example of the present disclosure. The system environment 500 may comprise at least a portion of a public networking environment or a private networking environment, or a combination thereof. In one implementation, the system environment 500 includes a processing resource 502 communicatively coupled to a computer readable medium 504 through a communication link 506.

For example, the processing resource 502 can include either a single processor or a group of processors of a computing device for ascertaining a count of print media available within the media tray 104 of the device 102. In another example, multiple processors may also be used for implementing the processing resource 502. The computer readable medium 504 may be, for example, an internal memory device of the computing device or an external memory device. In one implementation, the communication link 506 may be a direct communication link, such as any memory read/write interface. In another implementation, the communication link 506 may be an indirect communication link, such as a network interface. In such a case, the processing resource 502 can access the computer readable medium 504 through a network 508. The network 508 may be a single network or a combination of multiple networks and may use a variety of different communication protocols.

The processing resource 502 and the computer readable medium 504 may also be coupled to data sources 510 through the communication link 506, and/or to communication devices 512 over the network 508. The coupling with the data sources 510 enables in receiving the data in an offline environment, and the coupling with the communication devices 512 enables in receiving the data in an online environment.

In one example implementation the computer readable medium 504 includes a set of computer readable instructions, implementing a media count module(s) 514. The instructions implementing usage media count module(s) 514 may, in one example, be executable code for ascertaining a count of print media available within the media tray 104 of the device 102. The set of computer readable instructions within medium 504 may be accessed by the processing resource 502 through the communication link 506 and subsequently executed to process data communicated with the data sources 510 for generating an outline preview of a printed medium.

For ascertaining a count of print media available within the media tray 104 of the device 102, a series of sensors, such as sensors 106, may be linearly arranged on an internal vertical wall of the media tray 104, with each of the sensors 106 mounted at different vertical height with respect to the bottom of the media tray 104. As would be understood, the measure of vertical height from the bottom of media tray 104 is only one example arrangement.

The sensors 106 of the series of sensors 106 may be proximity sensors. The sensors 106, the proximity sensors, may sense or ascertain positioning of the stack of print media at an initial level L1 using an initial sensor, say sensor 106-1, from amongst the series of sensors 106. In one example, the initial sensor 106-1 may be a sensor laying beneath the initial level L1 of the stack of print media, and the initial level L1 may be a top of stack of the print media. The initial level L1 may be sensed by the initial sensor 106-1 when the top of the stack is at a threshold distance from the initial sensor 106-1 and is in line of sensing of the initial sensor 106-1.

The signals received from any of the sensors 106, such as sensor 106-1, may be received by the media count module(s) 514 based on which it ascertains the initial level of the stack of the print media. Thereafter, the media count module(s) 514 may continuously monitor and intercept signals being generated by any one of the lower sensors 106, such as sensor 106-2, as the level of the print media stack decreases during the rendering operation. For example, the media count module(s) 514 may utilize the signals received from the sensors 106 laying beneath the initial sensor 106-1 to determine the position of the print media at the next lower level L2 within the media tray 104.

Upon determination of the position of the print media at the next lower level L2, the media count module(s) 514 may count the number of the print media which have been utilized for the rendering operation since the initial level L1 being sensed till the next lower level L2 reaches, to determine a value of the preliminary count. The preliminary count may be assumed to be a value of the number of the media count present between the adjacent sensors, or between adjacent levels sensed by the adjacent sensors. The media count module(s) 514 may further ascertain an estimate count of the print media available within the media tray 104 at the next lower level L2. The ascertaining may be accomplished by multiplying the value of the preliminary count with the number of number of sensors beneath the initial sensor 106-1.

Continuing further, the media count module(s) 514 may further continue to count the media print available within the media tray 104 in case the processing of the rendering operation continues even beyond the next lower level L2 of the stack of print media. In one example, the media count module(s) 514 may keep a count of print media utilized for further processing of the rendering operation beyond the next lower level L2, and then decrement that count from the previously ascertained estimate count of the print media. Such accurate decrementing count of the print media may be continuously displayed on a display device integrated within the device 102 or a command-provider computing device. The continuous display of the estimate count or the decrementing count of the print media may enable the user of the device 102 to determine and obtain an accurate count of the print media present in the media tray 104 as the rendering operation is being processed. Furthermore, it may also ascertain whether appropriate amount of print media is available when the rendering operation has been initiated, based on the available print media in the media tray 104.

Although example for the present disclosure have been described in language specific to structural features and/or methods, the appended claims are not necessarily limited to the specific features or methods described. Rather, the specific features and methods are disclosed and explained as examples of the present disclosure.

We claim:

1. A device comprising:
a media tray to store a stack of print media;
a series of sensors mounted on an internal vertical wall of the media tray with each of the plurality of sensors mounted at a different vertical height, wherein each of the series of sensors is to sense level of the stack of print media; and
a media count engine coupled to the series of sensors, wherein the media count engine is to:
generate an estimate count of the print media available in the media tray based on the sensing by any one of the series of sensors;
determine a number of print media utilized for a rendering operation; and
in response to the determining, update the estimate count of the print media available in the media tray.

2. The device as claimed in claim 1, wherein the media count engine is to:
determine level of the stack of print media based on detection of an initial level of the stack of the print media by an initial sensor from amongst the series of sensors;
on utilization of print media from the stack, further determine another lower level of the stack by a next lower sensor from amongst the series of sensors;
determining a preliminary count of print media utilized as the level of the stack changed from the initial level to the another lower level; and
generate the estimate count of the print media based on a value of the preliminary count and a number of sensors positioned beneath the initial sensor.

3. The device as claimed in claim 1 further coupled to a display device, wherein the display device is to display the estimated count of the print media.

4. The device as claimed in claim 1, further comprising an alert engine coupled to the media count engine, wherein the alert engine is to:
process a command for a rendering operation to determine an intended number of print media to be utilized;
compare the determined intended print media with the estimate count of the print media; and
generate an audio or visual alert for a user based on the comparison.

5. The device as claimed in claim 1, wherein each of the series of sensors is one of capacitive based proximity sensor and a photoelectric based proximity sensor.

6. The device as claimed in claim 1, wherein the sensors in the series of sensors are equally spaced from each other.

7. A method comprising:
ascertaining position of a print media within a media tray of a device at an initial level through an initial sensor from amongst of a series of sensors, wherein the series of proximity sensors are mounted on an internal vertical wall of the media tray with each of the plurality of sensors mounted at a different vertical height;
detecting a next lower level of stack of the print media by a next lower sensor from amongst the series of sensors;
determining a preliminary count based on quantity of print media utilized between the initial level and the next lower level during processing of a rendering operation; and
generating an estimate count of the print media based on a value of the preliminary count and a number of sensors positioned beneath the initial sensor.

8. The method as claimed in claim 7, wherein the generating is based on multiplying the value of the preliminary count and the number of sensors positioned beneath the initial sensor on the internal vertical wall of the media tray.

9. The method as claimed in claim 7, wherein the generating further comprises:
retrieving a value of a preliminary count, wherein the value of the preliminary count corresponds to a value of a preliminary count determined during processing of previous rendering operations at the device;
determine a number of sensors present between a topmost print media and a bottom of the media tray; and
generating the estimate count of the print media based on the preliminary count and the determined number of sensors.

10. The method as claimed in claim 7 further comprising:
counting a number of individual print media utilized for processing a rendering operation;
decrementing the counted number of individual print media utilized for processing the rendering operation from the estimated count of the print media available in the media tray; and
generating an updated estimate count of the print media available in the media tray based on the decrementing count.

11. The method as claimed in claim 10 further comprising
receiving the updated count of the print media available in the media tray; and
displaying the updated count of the print media to notify a user.

12. The method as claimed in claim 10 further comprises:
processing the rendering operation received at the device to determine an intended number of print media to be utilized for processing the complete rendering operation;
comparing the determined intended print media with the estimated count or the decrementing count; and generating an audio or visual alert for a user based on the comparison.

13. A non-transitory computer-readable medium comprising instructions executable by a processing resource to:

ascertain position of a print media within a media tray of a device at an initial level based on proximity of the print media from an initial sensor from amongst a series of sensors, wherein the series of proximity sensors are mounted on an internal vertical wall of the media tray with each of the plurality of sensors mounted at a different vertical height;

detect another next lower level of stack of the print media by a next lower sensor from amongst the series of sensors;

determine a preliminary count based on quantity of print media utilized between the initial level and the another next lower level for processing a rendering operation; and generate an estimate count of the print media based on a value of the preliminary count and a number of sensors positioned beneath the initial sensor.

14. The non-transitory computer-readable medium as claimed in claim 13, further comprising instructions to:

receive the estimated count of the print media available in the media tray; and display the estimated count of the print media to notify a user.

* * * * *